US010883320B2

(12) United States Patent
Lu et al.

(10) Patent No.: US 10,883,320 B2
(45) Date of Patent: Jan. 5, 2021

(54) GROUND WELLHOLE DEDICATED PROTECTIVE PIPE FOR GAS EXTRACTION OF MINING-INDUCED AREA

(71) Applicant: SHANDONG UNIVERSITY OF SCIENCE AND TECHNOLOGY, Qingdao (CN)

(72) Inventors: Wei Lu, Qingdao (CN); Qianting Hu, Qingdao (CN); Guansheng Qi, Qingdao (CN); Weimin Cheng, Qingdao (CN); Jinliang Li, Qingdao (CN); Dong Wang, Qingdao (CN); Zhen Liu, Qingdao (CN)

(73) Assignee: SHANDONG UNIVERSITY OF SCIENCE AND TECHNOLOGY, Qingdao (CN)

( * ) Notice: Subject to any disclaimer, the term of this patent is extended or adjusted under 35 U.S.C. 154(b) by 0 days.

(21) Appl. No.: 16/624,984

(22) PCT Filed: Jul. 13, 2018

(86) PCT No.: PCT/CN2018/095653
§ 371 (c)(1),
(2) Date: Dec. 20, 2019

(87) PCT Pub. No.: WO2019/042026
PCT Pub. Date: Mar. 7, 2019

(65) Prior Publication Data

US 2020/0217202 A1 Jul. 9, 2020

(30) Foreign Application Priority Data

Sep. 1, 2017 (CN) ..... 2017 1 0777105

(51) Int. Cl.
*E21B 41/00* (2006.01)
*E21B 17/00* (2006.01)
*E21B 17/10* (2006.01)

(52) U.S. Cl.
CPC ..... *E21B 17/10* (2013.01); *E21B 17/00* (2013.01); *E21B 41/00* (2013.01)

(58) Field of Classification Search
CPC .. E21B 17/10; E21B 17/1007; E21B 17/1035; E21B 17/1085; E21B 41/00; E21B 17/00
See application file for complete search history.

(56) References Cited

U.S. PATENT DOCUMENTS 4,099,564 A * 7/1978 Hutchison ..... E21B 17/1078 166/241.1
5,803,193 A * 9/1998 Krueger ..... E21B 17/1064 175/325.1

(Continued)

FOREIGN PATENT DOCUMENTS

CN 105298538 A 2/2016
CN 107461159 A 12/2017
WO 2019042026 A1 3/2019

OTHER PUBLICATIONS

International Search Report issued in corresponding International Application No. PCT/CN2018/095653, dated Sep. 27, 2018, State Intellectual Property Office of the P.R. China, Beijing, China.

(Continued)

*Primary Examiner* — Robert E Fuller
(74) *Attorney, Agent, or Firm* — Hauptman Ham, LLP

(57) ABSTRACT

A ground wellhole dedicated protective pipe, disposed inside a ground wellhole for gas extraction of a mining-induced area, includes a casing, and a chain inside the casing and slidable relative to the casing. The chain includes a chain formed by a plurality of chain drums through serial connection, and a detachable connecting piece connecting between (Continued)

chains. A plurality of air holes is opened in the chain drum along an axial direction of the chain drum.

8 Claims, 3 Drawing Sheets

(56) References Cited

U.S. PATENT DOCUMENTS

| | | | | |
|---|---|---|---|---|
| 7,096,940 | B2 * | 8/2006 | Baxter | E21B 17/1085 166/241.6 |
| 7,493,948 | B2 * | 2/2009 | Cooper | E21B 17/1014 166/173 |
| 2003/0192720 | A1 * | 10/2003 | Mitchell | E21B 17/1007 175/325.3 |

OTHER PUBLICATIONS

Written Opinion issued in corresponding International Application No. PCT/CN2018/095653, dated Sep. 27, 2018, State Intellectual Property Office of the P.R. China, Beijing, China.
Chinese Search Report issued in corresponding Chinese Patent Application No. 201710777105.1, dated Aug. 20, 2018.
First Office Action issued in corresponding Chinese Patent Application No. 201710777105.1, dated Aug. 31, 2018.
Notification to Grant Patent Right for Invention dated Jan. 15, 2019 and English Translation from corresponding application No. CN 201710777105.1.

* cited by examiner

GROUND WELLHOLE DEDICATED PROTECTIVE PIPE FOR GAS EXTRACTION OF MINING-INDUCED AREA

RELATED APPLICATIONS

The present application is a National Phase of International Application Number PCT/CN2018/095653, filed Jul. 13, 2018, and claims the priority of Chinese Application No. 201710777105.1, filed Sep. 1, 2017.

TECHNICAL FIELD

The present disclosure relates to the technical field of gas extraction of a mining-induced area in a coal mine, and in particular to a ground wellhole dedicated protective pipe for gas extraction of a mining-induced area.

BACKGROUND

Gas extraction performed for "a place that is already mined or a place where a coal seam is loosened due to another reason" is generally referred to as gas extraction of a mining-induced area. Specifically, vertical drilling is performed to above the coal seam through ground operations to extract gas of a pressure relief zone in front of a mining working face and gas of a subsequent gob, and drilling is directly performed in an old gob through operations to extract old gob gas. The gas is relatively easy to extract because the gas extraction of the mining-induced area is pressure relief extraction. However, in the mining-induced area, extraction drilling channels passing through a rock stratum and a coal seam of the mining-induced area are easily damaged by acting forces such as displacement, squeezing, stretching and shearing forces of the rock stratum. Since these acting forces are extremely huge, the drilling channels and their protective pipes are often easily damaged and deformed or well channels are closed at a position where the acting force between the rock stratums or between the rock stratum and the coal seam, or the like is concentrated, and therefore the gas cannot be extracted continuously and smoothly, thereby causing severe economic losses and safety risks. This is because the protective pipe is of a hollow structure which cannot withstand various huge acting forces generated by a relative movement of the rock stratum. Thus, the protective pipe may also be broken in spite of being thickened.

To protect the drilling channels (extraction channels), engineering personnel mount deflecting and telescoping protective structure apparatuses and flexible and thick-wall rigid protective structures, and the like for engineering protection at high-risk positions of the drilling channels. These apparatuses protect the drilling channels to some extent, but there are still some shortcomings. For example, a protective apparatus deflecting at a given position does not act as desired because the acting force of the rock stratum usually does not act directly on the position or a severe displacement occurs. In addition, the acting manners of the rock stratum include displacement, squeezing and stretching and so on and thus the acting forces are complex. The drilling channel may be disabled as long as one of such actions exists. The apparatus for simply preventing only one of the deflection, stretching and squeezing actions cannot achieve a purpose of effective protection. Meanwhile, these apparatuses generally are of the hollow structure, which cannot withstand the huge acting force of the rock stratum.

SUMMARY

To solve the technical problem that the ground wellhole for gas extraction of the mining-induced area is easily damaged by the acting force of the rock stratum at present, the present disclosure provides a ground wellhole dedicated protective pipe for gas extraction of a mining-induced area (a borehole support pipe for an earth formation).

The present disclosure provides a ground wellhole dedicated protective pipe for gas extraction of a mining-induced area. The ground wellhole dedicated protective pipe for gas extraction of the mining-induced area is disposed inside a ground wellhole for gas extraction of the mining-induced area. The ground wellhole dedicated protective pipe for gas extraction of the mining-induced area includes a casing and a chain that is disposed inside the casing and slidable relative to the casing, where the chain includes a plurality of chain drums and connecting pieces movably connecting adjacent chain drums, and a plurality of air holes are opened in the chain drum along an axial direction of the chain drum.

Further, an upper end and a lower end of the chain drum are both provided with a lug hole, the connecting piece is a connection ring, and the connection ring connects the lug holes of the adjacent chain drums respectively.

Further, the connection ring includes a closed connection ring and an open-closed connection ring, a plurality of chain drums are connected into one chain through the closed connection rings, and the adjacent chains are connected through the open-closed connection rings.

Further, one end of open-closed ends of the open-closed connection ring is provided with a thread insert, and the other end is provided with a screw thread-connected with the thread insert.

Further, an upper end of the casing is provided with a connection buckle, and the connection buckle is connected with the chain through a cable.

Further, a lower end of the casing is provided with a porous mesh plate, and the porous mesh plate supports the chain.

Further, a center axis of the air hole is parallel to a center axis of the chain drum.

Further, the casing is made of stainless steel.

Further, the chain drum is made of stainless steel.

Further, the connecting piece is made of stainless steel.

Compared with the prior art, the ground wellhole dedicated protective pipe for gas extraction of a mining-induced area of the present disclosure has the following features and advantages.

The ground wellhole dedicated protective pipe for gas extraction of a mining-induced area of the present disclosure can resist a change and a failure of the casing caused by a shearing force, a squeezing force and a stretching force generated by a displacement of a rock stratum simultaneously, and ensure the gas passes under one or more forces regardless of that displacement or force occurs in a protection region in the ground wellhole for gas extraction of the mining- induced area. Therefore, the protective pipe has versatility, economy and applicability compared with traditional protection methods and apparatuses.

The features and advantages of the present disclosure will become clearer after specific examples of the present disclosure are read in combination with accompanying drawings.

BRIEF DESCRIPTION OF THE DRAWINGS

To describe the technical solutions in the examples of the present disclosure or in the prior art more clearly, the accompanying drawings required in descriptions of the examples of the present disclosure or the prior art will be briefly introduced below. It is apparent that the accompanying drawings described below are some examples of the present disclosure and other drawings may be obtained by those of ordinary skill in the art based on these drawings without paying creative work.

Figure 1:
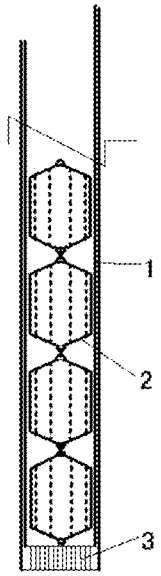
FIG. 1 is a schematic diagram illustrating a structure of a ground wellhole dedicated protective pipe for gas extraction of a mining-induced area according to an example of the present disclosure.
Figure 2:
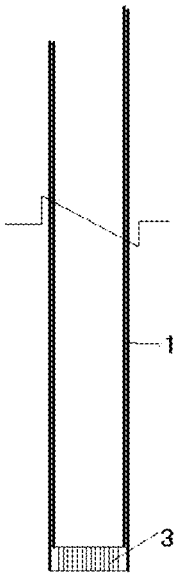
FIG. 2 is a schematic diagram illustrating structures of a casing and a porous mesh plate in a ground wellhole dedicated protective pipe for gas extraction of a mining-induced area according to an example of the present disclosure.
Figure 3:
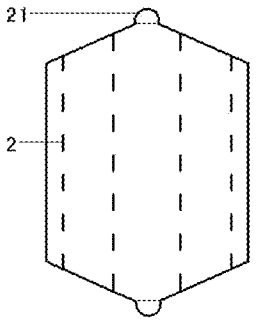
FIG. 3 is a front view of a chain drum in a ground wellhole dedicated protective pipe for gas extraction of a mining-induced area according to an example of the present disclosure.
Figure 4:
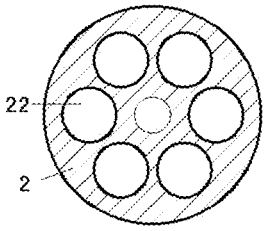
FIG. 4 is a section view of a chain drum in a ground wellhole dedicated protective pipe for gas extraction of a mining-induced area according to an example of the present disclosure.
Figure 5:
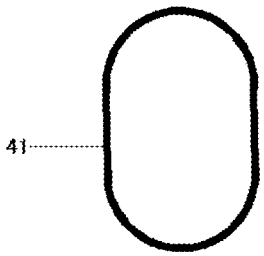
FIG. 5 is a schematic diagram illustrating a structure of a closed connection ring in a ground wellhole dedicated protective pipe for gas extraction of a mining-induced area according to an example of the present disclosure.
Figure 6:
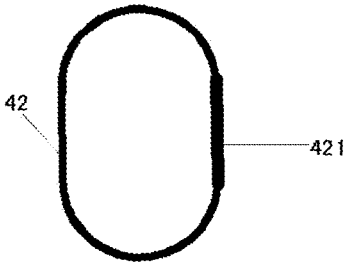
FIG. 6 is a schematic diagram illustrating a structure of an open-closed connection ring in a ground wellhole dedicated protective pipe for gas extraction of a mining-induced area according to an example of the present disclosure.
Figure 7:
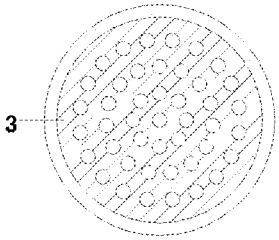
FIG. 7 is a top view of a porous mesh plate in a ground wellhole dedicated protective pipe for gas extraction of a mining-induced area according to an example of the present disclosure.

Numerals of the drawings are described as follows: 1—a casing, 2—a chain drum, 21—an lug hole, 22—an air hole, 3—a porous mesh plate, 41—a closed connection ring, 42—an open-closed connection ring, and 421—a thread insert.

DETAILED DESCRIPTION OF THE EMBODIMENTS

As shown in FIGS. 1-7, an example of the present disclosure provides a ground wellhole dedicated protective pipe for gas extraction of a mining-induced area, which is disposed inside a ground wellhole for gas extraction of the mining-induced area. During gas extraction of the mining-induced area, a stainless-steel casing 1 with particular flexibility is disposed at a position of a rock stratum to which a transverse movement, up and down expansion stretching, transverse squeezing, longitudinal squeezing, and the like easily occur in a ground drilling (well) hole. The stainless-steel casing 1 may realize flexible deformation to some extent. A chain is disposed inside the casing 1, and may slide relative to the casing 1. The chain includes a plurality of chain drums 2 and connecting pieces movably connecting the adjacent chain drums 2. The chain may be bent along with bending of the casing 1 and automatically slide along with longitudinal stretch or compression of the casing 1. But the chain will not be obviously deformed along with squeeze of the casing 1. A bending angle between two chain drums 2 is not less than 45 degrees, and a bending angle of three chain drums 2 is not less than 90 degrees.

In the example, the chain drum 2 is a cylinder made of stainless steel, an upper end and a lower end of the chain drum 2 are both provided with an lug hole 21. The connecting piece in the present example preferably is a connection ring, and the connection ring is connected to the lug holes of the adjacent chain drums 2 respectively. The connection ring includes a closed connection ring 41 and an open-closed connection ring 42, which are both made of stainless steel. One end of open-closed ends of the open-closed connection ring 42 is provided with a thread insert 421, and the other end of open-closed ends of the open-closed connection ring 42 is provided with a screw thread-connected with the thread insert 421. In a production process, a plurality of chain drums 2 are connected into one chain through the closed connection rings 41. For example, in FIG. 1, four chain drums 2 are serially connected into one chain through the closed connection rings 41. In engineering operations, operation personnel serially connect different chains into one whole long chain through the open-closed connection rings 42. A plurality of air holes 22 are opened in the chain drum 2 along an axial direction of the chain drum 2, so that gas in the casing 1 may smoothly pass through the air holes 22. It is noted that a design air permeability is not less than 50%. In the example, a center axis of the air hole 22 is parallel to a center axis of the chain drum 2 to reduce air passing resistance.

Before the drilling operation of the mining-induced area is completed without obvious deformation, regions of different rock strata liable to deformation, displacement and squeeze are pre-determined according to geological data and a detection situation obtained during drilling, and a chain is disposed at the position of the region where the casing 1 is located. If an operation manner of drilling and disposing the casing 1 from top to bottom is adopted, a connection buckle, for example, a hook, is disposed at an upper end of the casing 1, the connection buckle is connected to the chain with a particular length through a cable, and the chain is hung inside the casing 1, where the length of the chain goes beyond the above region. If an operation manner of drilling and disposing the casing 1 from bottom to top is adopted, a porous mesh plate 3 is disposed at a lower end of the casing 1, the porous mesh plate 3 supports the chain, where the length of the chain goes beyond the above region. Of course, no matter which of the above operation manners is adopted, the chain may also be disposed over the whole length of the casing 1.

Figure 8:
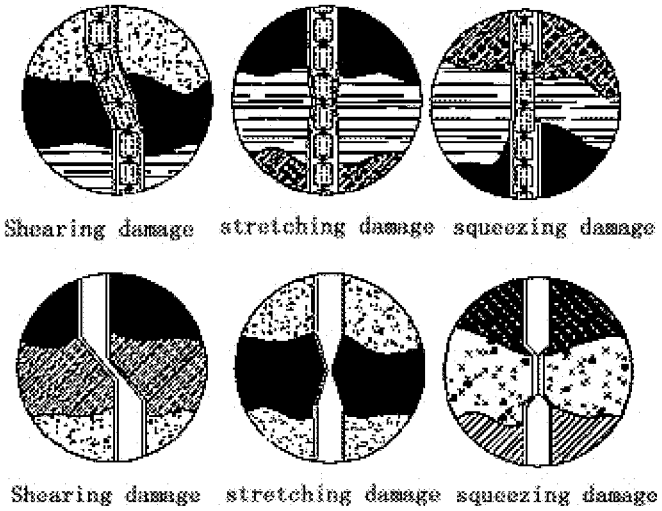
FIG. 8 is a comparison diagram of effects of applying a ground wellhole dedicated protective pipe for gas extraction of a mining-induced area and a traditional protective pipe to gas extraction of a mining-induced area respectively according to an example of the present disclosure.

As shown in FIG. 8, the ground wellhole dedicated protective pipe for gas extraction of a mining-induced area in the present example is applied to gas extraction of the mining-induced area, and an operation effect thereof is illustrated in three pictures on the first row. As a comparison, only a traditional protective pipe is applied to the gas extraction of the mining-induced area, and an operation effect thereof is illustrated in three pictures on the second row. It can be seen from the comparison of two protective pipes that the traditional protective pipe is deformed significantly and the gas inside the pipe cannot pass smoothly, but the ground wellhole dedicated protective pipe for gas extraction of a mining-induced area in the present example is not deformed significantly and the gas inside the pipe can still pass smoothly.

The ground wellhole dedicated protective pipe for gas extraction of a mining-induced area in the present example can resist the change and the failure of the casing 1 caused by the shearing force, the squeezing force and the stretching force generated by the displacement of the rock stratum simultaneously, and ensure the gas passes under one or more forces no matter what displacement or force occurs in a protection region in the ground wellhole for gas extraction of the mining-induced area. Therefore, the protective pipe has versatility, economy and applicability compared with traditional protection methods and apparatuses. Specific effects are described below.

1. Since the chain disposed inside the casing 1 has a particular length, a protective scope of the casing is substantially same or slightly smaller than the chain length. Thus, protection of linear length may be performed without accurately determining a position of displacement of the rock stratum. However, since the position of one point is protected by the traditional method and protective apparatus, it is required to accurately determine the easily-displaced position of the rock stratum. However, it is very difficult to accurately determine the easily-displaced position of the rock stratum. When the protective apparatus is disposed inside the casing 1, it is also very difficult to align the position of the protective apparatus with the easily-displaced position of the rock stratum.

2. As long as the chain is not broken or crushed, no matter what stress acts on the casing 1, it can be effectively ensured that an inner diameter of the casing 1 is not changed greatly, that is, a gas passing capability is not changed obviously. However, the traditional method and protective apparatus can only resist or eliminate the change of one acting force, for example, the deflecting protective apparatus can only have an effect on the shearing action, without obvious protective effect on the squeezing and stretching forces. For example, if the casing 1 is made flexible, the pipe has the protective effect on stretch without protective effect on squeezing and shearing actions.

From the perspective of a single action effect, the ground wellhole dedicated protective pipe for gas extraction of a mining-induced area in the present example has superiority. From the perspective of an anti-squeezing force, to prevent the casing 1 from being broken due to squeeze or prevent the casing 1 from being closed and air-blocked due to squeeze, a solution is generally adopted to thicken a pipe wall of the casing 1 to increase a pressure bearing capability. However, the thickness of the pipe wall is limited, and therefore a pressure bearing capability thereof is also limited. From the perspective of anti-stretching and anti-shearing forces, since it is not required to give a special consideration to the anti-squeezing capability of the casing 1 during an application of the ground wellhole dedicated protective pipe for gas extraction of a mining-induced area in the present example, a material with good plasticity may be selected for the casing 1. However, in other methods and protective apparatuses, contradiction exists when the material of the casing 1 is selected, that is, when a soft material or a plastic material is selected, the material does not have anti-squeeze capability, and when an anti-squeezing hard material is selected, the material does not have anti-stretching and anti-shearing capabilities.

4. When the ground wellhole dedicated protective pipe for gas extraction of a mining- induced area in the present example is adopted, the inner diameter of the casing 1 remains basically unchanged at any time. Therefore, the gas passing capability inside the casing 1 also remains stable, which has a positive significance on stability and economy of an extraction system. Further a surplus design coefficient is reduced during system design.

Of course, the above descriptions are not intended to limit the present disclosure, and the present disclosure is also not limited to the above examples. Changes, modifications, additions or substitutions made by persons skilled in the art shall also be encompassed in the scope of protection of the present disclosure.

The invention claimed is:

1. A ground wellhole dedicated protective pipe for gas extraction of a mining-induced area, wherein the ground wellhole dedicated protective pipe for gas extraction of the mining-induced area is disposed inside a ground wellhole for gas extraction of the mining-induced area, the ground wellhole dedicated protective pipe for gas extraction of the mining-induced area comprising:

a casing; and a chain that is disposed inside the casing and slidable relative to the casing, the chain comprising a plurality of chain drums, and connecting pieces, wherein a plurality of air holes are opened in the chain drum along an axial direction of the chain drum, the connecting piece is a connection ring, the connection ring comprises a closed connection ring, and an open-closed connection ring, the plurality of chain drums are connected through the closed connection rings, and the adjacent chains are connected through the open-closed connection rings.

2. The ground wellhole dedicated protective pipe for gas extraction of the mining-induced area according to claim 1, wherein an upper end and a lower end of the chain drum are both provided with a lug hole, and the connection ring connects the lug holes of the adjacent chain drums respectively.

3. The ground wellhole dedicated protective pipe for gas extraction of the mining-induced area according to claim 2, wherein one end of open-closed ends of the open-closed connection ring is provided with a thread insert, and the other end is provided with a screw thread-connected with the thread insert.

4. The ground wellhole dedicated protective pipe for gas extraction of the mining-induced area according to claim 1, wherein a lower end of the casing is provided with a porous mesh plate, and the porous mesh plate supports the chain.

5. The ground wellhole dedicated protective pipe for gas extraction of the mining-induced area according to claim 1, wherein a center axis of the air hole is parallel to a center axis of the chain drum.

6. The ground wellhole dedicated protective pipe for gas extraction of the mining-induced area according to claim 1, wherein the casing is made of stainless steel.

7. The ground wellhole dedicated protective pipe for gas extraction of the mining-induced area according to claim 1, wherein the chain drum is made of stainless steel.

8. The ground wellhole dedicated protective pipe for gas extraction of the mining-induced area according to claim 1, wherein the connecting piece is made of stainless steel.

* * * * *